US005945905A

United States Patent [19]

Mazzochette

[11] Patent Number: 5,945,905

[45] Date of Patent: Aug. 31, 1999

[54] HIGH POWER RESISTOR

[75] Inventor: Joseph B. Mazzochette, Cherry Hill, N.J.

[73] Assignee: EMC Technology LLC, Cherry Hill, N.J.

[21] Appl. No.: 09/217,301

[22] Filed: Dec. 21, 1998

[51] Int. Cl.[6] ..... H01C 1/08

[52] U.S. Cl. ..... 338/51; 338/52; 338/60; 338/313; 338/309

[58] Field of Search ..... 338/51, 306, 307, 338/308, 309, 313, 314

[56] References Cited

U.S. PATENT DOCUMENTS

| | | | |
|---|---|---|---|
| 3,694,786 | 9/1972 | Rosema et al. . | |
| 5,179,366 | 1/1993 | Wagner | 338/313 |
| 5,304,977 | 4/1994 | Caddock, Jr. . | |
| 5,621,378 | 4/1997 | Caddock, Jr. et al. . | |
| 5,739,743 | 4/1998 | Mazzochette . | |

*Primary Examiner*—Michael L. Gellner
*Assistant Examiner*—Richard Lee
*Attorney, Agent, or Firm*—Donald S. Cohen

[57] ABSTRACT

A high power resistor includes a substrate of an insulating material having opposed first and second surfaces, and a strip of a resistance material on the first surface of the substrate. The resistance strip has side edges which are spaced from the side edges of the substrate. A contact of a conductive material is at each end of the resistance strip. Each contact extends to a separate end of the substrate, across the end and over a portion of the second surface of the substrate. The portions of the contacts which are on the second surface of the substrate or no longer than the portions of the contacts on the first surface of the substrate. At least one heat sink strip of a conductive material is on the second surface of the substrate. The heat sink strip is of a size that it does not overlap the resistance strip so as to minimize any capacitance between the heat sink strip and the resistance strip.

7 Claims, 2 Drawing Sheets

HIGH POWER RESISTOR

FIELD OF THE INVENTION

The present invention relates to a high power resistor, and, more particularly to a high power resistor having good heat dissipation and low capacitance.

BACKGROUND OF THE INVENTION

Chip resistors are resistors in which a resistance film is coated on a substrate and which is surface mounted on a printed circuit board. To permit for ease of mounting a chip resistor on a printed circuit board, the resistor has no leads or terminals projecting therefrom, but merely has metal termination films at each end of the resistance film which terminal films extends onto a surface of the substrate opposite that on which the resistance film is located. The terminal films are then mounted on the surface of the printed circuit board and soldered to conductive strips on the board.

Resistors generate heat which must be dissipated from the resistor to prevent overheating of the resistor and the possibility of burning out the resistor. High power resistors generate considerable heat which must be conducted away from the resistor by either conduction to the printed circuit board through the terminal films, by convection or by radiation. One technique which has been developed to provide greater conduction of heat from the resistor to the printed circuit board is to increase the size of the termination films on the surface of the substrate opposite the resistance film. The larger termination films conduct a larger amount of heat from the resistor. One such resistor is shown in U.S. Pat. No. 5,739,743 to J. B. Mazzochette, issued Apr. 14, 1998, entitled ASYMMETRIC RESISTOR TERMINAL. Another technique which has been developed is to provide a metal film heat sink on the surface of the substrate opposite the resistance film to conduct additional heat from the resistor. Such a resistor is shown in U.S. Pat. No. 5,179,366 to R. Wagner, issued Jan. 12, 1993, entitled END TERMINATED HIGH POWER CHIP RESISTOR ASSEMBLY. However, a problem with each of these types of resistors is that there is a metal film, either a portion of the termination film or a heat sink film, which is directly opposite the resistance film. This provides a capacitance between the resistance film and the opposing metal film. Such a capacitance is undesirable in a high power resistor which operates at RF. Therefore, it would be desirable to have a high power resistor which has good heat dissipation but minimizes any capacitance between the resistance film and a metal film on the substrate.

SUMMARY OF THE INVENTION

A resistor includes a substrate of an insulating material having first and second opposed surfaces and edge surfaces. A film of a resistance material is on a portion of the first surface of the substrate and has a pair of ends. A separate contact of a film of a conductive material is on the first surface of the substrate at each end of the resistance film. A heat sink film of a conductive material is on a portion of the second surface of the substrate and positioned away from the resistance film so that it is not directly opposite the resistance film.

DETAILED DESCRIPTION OF PREFERRED EMBODIMENT

Figure 1:
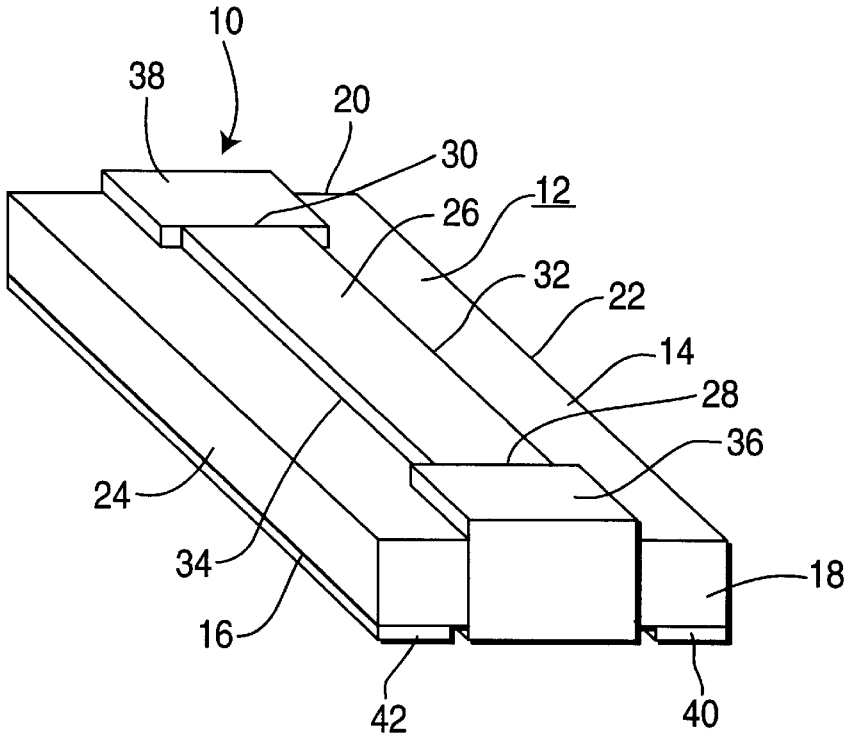
FIG. 1 is a perspective view of a form of the resistor of the present invention.
Figure 2:
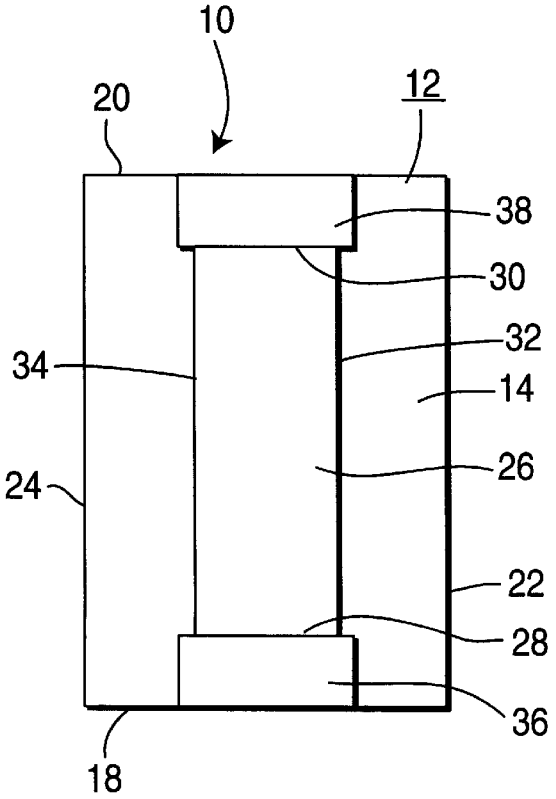
FIG. 2 is a top view of the resistor of the present invention.

Referring initially to FIG. 1, a form of the resistor of the present invention is generally designated as 10. Resistor 10 comprises a rectangular substrate 12 of an insulating material, such as a ceramic of plastic. Substrate 12 has opposed, rectangular top and bottom surfaces 14 and 16, opposed end surfaces 18 and 20 and opposed side surfaces 22 and 24 extending between the end surfaces 18 and 20.

Figure 3:
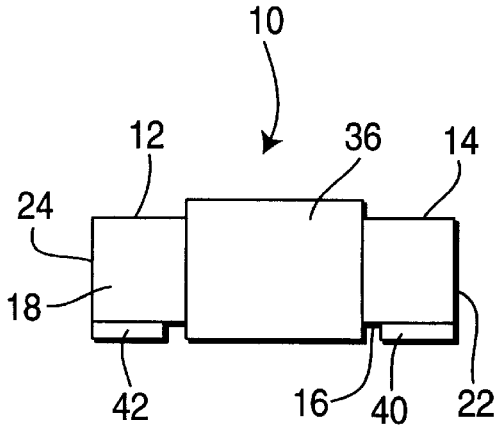
FIG. 3 is ane end view of the resistor shown in FIG. 1.
Figure 4:
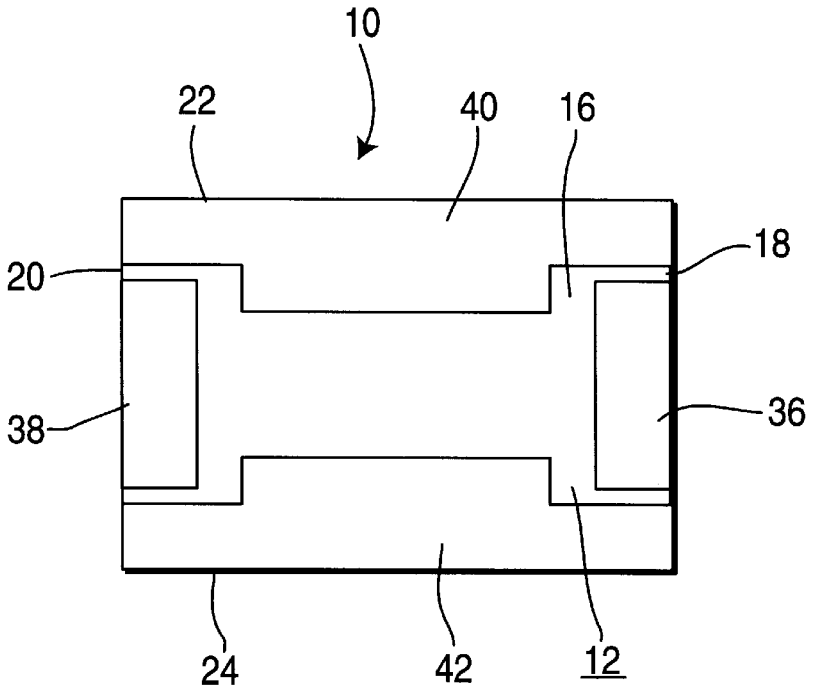
FIG. 4 is a bottom view of the resistor shown in FIG. 1.

A film 26 of a resistance material in the form of a strip is on the top surface 14 of the substrate 12 and extends between the end surfaces 18 and 20. The ends 28 and 30 of the resistance strip 26 are spaced from the end surfaces 18 and 20 of the substrate 12, and the side edges 32 and 34 of the resistance strip 26 are spaced from the side surfaces 22 and 24 of the substrate 12. Contact films 36 and 38 of a conductive material, such as a metal, are on the top surface 14 of the substrate 12 at the respective ends 28 and 30 of the resistance strip 26. The contacts 36 and 38 engage the respective ends 28 and 30 of the resistance film 26 and extend over the top surface 14 to the respective ends 28 and 30 of the substrate. As shown in FIGS. 1 and 3, the contacts 36 and 38 extend across the ends 28 and 30 of the substrate 12. As shown in FIG. 4, the contacts 36 and 38 also extend across a portion of the bottom surface 16 of the substrate 12. The portion of the contacts 36 and 38 which are on the bottom surface 16 of the substrate 12 are of a length no greater than the length of the portion of the contacts 36 and 38 on the top surface 14 of the substrate 12. Thus, the portion of the contacts 36 and 38 which are on the bottom surface 16 of the substrate do not overlap the resistance strip 26.

As shown in FIGS. 3 and 4, heat sink strips 40 and 42 of a film of an electrically and thermally conductive material, such as a metal, are on the bottom surface 16 of the substrate 12. The heat sink strips 40 and 42 extend along the sides 22 and 24 of the substrate 12 between the ends 18 and 20. The heat sink strips 40 and 42 are spaced from the contacts 36 and 38 and do not overlap the resistance strip 26.

Figure 5:
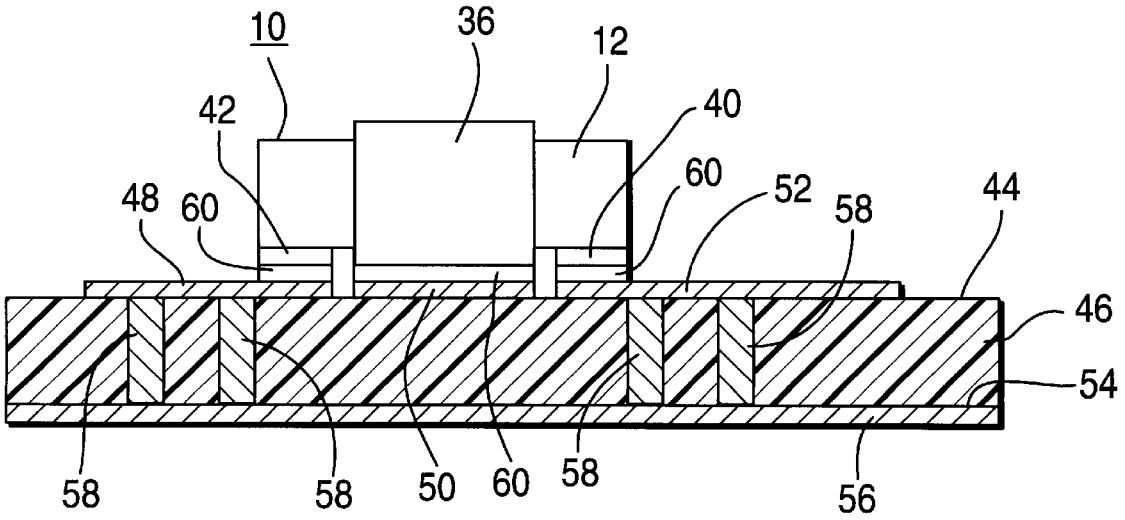
FIG. 5 is a sectional view of a heat dissipating support having the resistor of the present invention mounted thereon.

Referring to FIG. 5, there is shown the resistor 10 of the present invention mounted on a surface 44 of a printed circuit board 46. The printed circuit board 46 is of an insulating material, such as a plastic. On the surface 44 of the printed circuit board 46 are a plurality of strips of a conductive material, such as a metal. Shown in FIG. 5 are three conductive strips 48, 50 and 52. However, there may be many more of the strips on the surface 44 of the printed circuit board 46. The resistor 10 is seated on the surface 44 of the board 46 with the contact 38 being seated on and contacting the conductive strip 50. The heat sink strips 40 and 42 of the resistor 10 are seated on and are contacting the conductive strips 48 and 52 respectively. Although not shown, the contact 36 of the resistor 10 is also seated on and contacts a conductive strip, not shown. The contacts 36 and 38 and the heat sink strips 40 and 42 are secured to their respective conductive strips by a suitable conductive bonding material 60, such as a solder. On the surface 54 of the board, opposite the surface 44, is a layer 56 of a conductive material, such as a metal. The conductive layer 56 is electrically and thermally connected to the conductive strips 48 and 52 by vias 58 of a conductive material, such as a metal, which extend through the printed circuit board 46.

In the assembly shown in FIG. 5, the contacts 36 and 38 of the resistor 10 are electrically connected to conductive strips on the printed circuit board 46. The conductive strips can be connected to other electrical components which are mounted on the printed circuit board 46 or can be connected to terminals, not shown, for connection of the resistor 10 to other components which are not mounted on the printed circuit board 46. The heat sink strips 40 and 42 are thermally connected to the conductive layer 56 through the conductive strips 48 and 52 and the vias 58. Thus, heat from the resistor 10 is conducted through the heat sink strips 40 and 42 to the conductive layer 56. The printed circuit board 46 may be mounted on a heat sink, not shown, of a thermally conductive material so that the heat from the resistor 10 is conducted away from the resistor 10. Thus, the temperature of the resistor 10 is maintained at a relatively low value during the operation of the resistor 10 so that the resistor 10 can be suitably operated at high power. Although the heat sink strips 40 and 42 provide for good thermal conduction from the resistor 10, they are not directly opposed to the resistance strip 26 so that the capacitance between the resistance strip 26 and the heat sink strips 40 and 42 is minimized. Also, the portions of the contacts 36 and 38 which are on the back surface 16 of the substrate 12 do not overlap the resistance strip 26. This also minimizes the capacitance between the contacts 36 and 38 and the resistance strip 26.

Thus, there is provided by the present invention a high power chip resistor 10 which has good thermal conduction from the resistor 10 so as to maintain the resistor 10 at a relatively low value during its operation. In addition, the capacitance between the resistance strip 26 and each of the heat sink strips 40 and 42 and the contacts 36 and 38 are minimized so that the capacitance in the resistor 10 is maintained at a low value. If desired, the heat sink strips 40 and 42 can be connected to a contact 36 or 38 so that the heat sink strips will serve as electrical contacts to the resistance strip 26. Such connections should be made at the ends of the substrate 12 so as to maintain the low capacitance of the resistor 10.

What is claimed is:

1. A resistor comprising:

a substrate of an insulating material having first and second opposed surfaces, a pair of opposed end edges and a pair of opposed side edges extending between the end edges;

a film of a resistance material in the form of a strip on a portion of the first surface of the substrate and having ends, said resistance film strip having side edges which extend along but are spaced from the side edges of the substrate;

a separate contact of a film of a conductive material on said first surface of the substrate at each end of the resistance film; and a heat sink of a film of a conductive material separate from the contact films on a portion of the second surface of the substrate, said heat sink film extending along one side of the substrate but being narrower than the space between the said side edge of the substrate and the adjacent side edge of the resistance strip so that it does not overlap the resistance film.

2. The resistor of claim 1 further comprising two heat sink strips of a conductive material on the second surface of the substrate, each of said heat sink strips extending along a separate side edge of the substrate and being of a width less than the spacing between the side edges of the resistance strip and the side edges of the substrate so that the heat sink strips do not overlap the resistance strip.

3. The resistor of claim 2 in which each of the contacts extends to a separate end edge of the substrate, across the respective end edge of the substrate and over a portion of the second surface of the substrate.

4. The resistor of claim 3 in which the length of the portion of the contacts on the second surface of the substrate is no greater than the length of the portion of the contacts on the first surface of the substrate.

5. The resistor of claim 4 further comprising a printed circuit board of an insulating material having first and second opposed surfaces and strips of a conductive material on the first surface of the printed circuit board, the resistor is seated on the first surface of the printed circuit board with the portion of the contacts which are on the second surface of the substrate being seated on separate conductive strips of the printed circuit board, and the heat sink strips being seated on separate conductive strips of the printed circuit board.

6. The resistor of claim 5 in which the contacts and the heat sink strips of the resistor are secured to their respective conductive strips on the printed circuit board by a conductive bonding material.

7. The resistor of claim 6 in which the printed circuit board has a film of a conductive material on it second surface and means thermally connecting the conductive film on the second surface with the conductive strips on the first surface on which the heat sink strips of the resistor are seated.

* * * * *